US008876620B2

(12) United States Patent
Ahlberg

(10) Patent No.: US 8,876,620 B2
(45) Date of Patent: Nov. 4, 2014

(54) SPORTING EQUIPMENT HANDLE GRIP IMPROVEMENT APPARATUS

(76) Inventor: Erik Ahlberg, Sanford, FL (US)

( * ) Notice: Subject to any disclaimer, the term of this patent is extended or adjusted under 35 U.S.C. 154(b) by 171 days.

(21) Appl. No.: 13/591,599

(22) Filed: Aug. 22, 2012

(65) Prior Publication Data

US 2013/0047376 A1 Feb. 28, 2013

Related U.S. Application Data

(60) Provisional application No. 61/525,925, filed on Aug. 22, 2011.

(51) Int. Cl.
*A63B 57/00* (2006.01)
*A63B 59/00* (2006.01)
*A63B 71/14* (2006.01)

(52) U.S. Cl.
CPC ..... *A63B 71/143* (2013.01); *A63B 2243/0083* (2013.01); *A63B 59/00* (2013.01); *A63B 71/146* (2013.01)
USPC ..... 473/205

(58) Field of Classification Search
USPC ..... 473/205
See application file for complete search history.

(56) References Cited

U.S. PATENT DOCUMENTS 4,139,108 A * 2/1979 Kamp et al. ..... 414/749.1
4,632,105 A * 12/1986 Barlow ..... 602/64
4,785,755 A * 11/1988 Markison ..... 114/39.12
5,330,391 A * 7/1994 Mitchell ..... 473/59
5,353,440 A * 10/1994 Meldeau ..... 2/161.1
5,370,606 A * 12/1994 Martel et al. ..... 602/64
5,592,694 A * 1/1997 Yewer, Jr. ..... 2/161.1
5,593,353 A * 1/1997 Kramer ..... 473/205
5,704,845 A * 1/1998 Boyte ..... 473/205
5,742,942 A * 4/1998 Sykes ..... 2/161.4
5,873,130 A * 2/1999 Lafferty ..... 2/16
5,931,749 A * 8/1999 Hagey ..... 473/551
6,035,442 A * 3/2000 Marando ..... 2/161.1
6,073,269 A * 6/2000 Diaco ..... 2/160
6,106,418 A * 8/2000 Hagey et al. ..... 473/551
6,119,267 A * 9/2000 Pozzi ..... 2/20
6,142,966 A * 11/2000 Hely ..... 602/64
6,186,969 B1 * 2/2001 Bell et al. ..... 602/64
6,553,574 B1 * 4/2003 Hall et al. ..... 2/160
6,553,576 B1 * 4/2003 Knapp ..... 2/161.6
6,810,531 B1 * 11/2004 Lento ..... 2/159
6,872,157 B2 * 3/2005 Falone et al. ..... 473/568
6,912,732 B2 * 7/2005 Hatch et al. ..... 2/161.1
6,960,144 B2 * 11/2005 Tucker, Sr. ..... 473/513
6,988,745 B2 * 1/2006 Trinen et al. ..... 280/821
7,051,377 B1 * 5/2006 Milner et al. ..... 2/159
7,275,267 B2 * 10/2007 Thiruppathi ..... 2/161.1
7,322,612 B2 * 1/2008 Trinen et al. ..... 280/821

(Continued)

*Primary Examiner* — Kurt Fernstrom
*Assistant Examiner* — Dolores Collins
(74) *Attorney, Agent, or Firm* — John Alumit

(57) ABSTRACT

An apparatus for improving a user's grip on a sports equipment handle is made of a single substantially resilient deformable planar sheet of non-slip material. The planar sheet has a narrower first end in which a finger hole is disposed, and a wider second cad. To use the apparatus, a user places the apparatus on a finger with the wider end oriented toward the finger tips. A handle is placed on the wider end, and rolled toward a user's palm, thereby securing the apparatus to the user's hand. The apparatus may be disengaged by simply relaxing the grip on the handle and allowing it to rotate out of the apparatus.

3 Claims, 6 Drawing Sheets

(56) References Cited

U.S. PATENT DOCUMENTS

| | | | | |
|---|---|---|---|---|
| 7,415,735 | B2 * | 8/2008 | Erickson et al. | 2/163 |
| 7,445,570 | B2 * | 11/2008 | Rodgers et al. | 473/464 |
| 7,895,671 | B2 * | 3/2011 | Salomon | 2/161.2 |
| 8,033,925 | B2 * | 10/2011 | Hardage | 473/205 |
| 8,093,901 | B2 * | 1/2012 | Petrin et al. | 324/415 |
| 8,579,328 | B2 * | 11/2013 | Dobner | 280/821 |
| 2001/0001770 | A1 * | 5/2001 | Spangler et al. | 473/221 |
| 2001/0018378 | A1 * | 8/2001 | Burger | 473/561 |
| 2014/0057734 | A1 * | 2/2014 | Lu | 473/298 |
| 2014/0079900 | A1 * | 3/2014 | Ramirez | 428/41.8 |

* cited by examiner

SPORTING EQUIPMENT HANDLE GRIP IMPROVEMENT APPARATUS

This application claims the benefit of the filing date of provisional application No. 61/525,925, filed on Aug. 22, 2011.

BACKGROUND

Sporting equipment handles are a major stress point in performing a variety of sports, including golf, baseball, tennis, etc. Due to the stress placed the handle of a piece of sports equipment, the handle has a tendency to slip in a user's grasp, particularly after repeated use as a user's hands grow tired. Other issues causing slippage include saturation of the handle with sweat from a user's hand, and grips losing their surface characteristics over time.

Apparatus for enhancing or preserving a user's grip on a piece of sports equipment are known in the art. These devices typically comprise loops or straps for surrounding a user's wrist, or glove-like apparatus having surface characteristics for improving a user's grip. Apparatus in the art suffer from the drawback that they rely on the user's own strength to preserve the user's grip on a sporting equipment handle.

Therefore there is a need for a grip-improving apparatus that preserves the position of a sports equipment handle in a user's hand when gripped without relying on the strength of the user's grip. There is also a need for a grip-improving apparatus which allows a user to discard a piece of sports equipment quickly without complicated disengagement steps, and which may be easily installed and removed.

SUMMARY

An apparatus for improving a user's grip on a sports equipment handle comprises a planar sheet of deformable, but substantially elastically resilient material. Preferably the sheet is made of a material such as rubber, leather, or a resilient cloth-based slip-resistant material. The sheet is preferably approximately between one and 1.5 millimeters in thickness. It is also anticipated that the Sheet will he approximately 3 inches or 6.5 centimeters wide and 4 inches long, although different sizes are contemplated depending on the nature of the sports handle gripped.

A hole is located near one end of the sheet. The hole may be between 1.5 and 2 centimeters in diameter, although larger or smaller holes are contemplated depending on the size of a user's finger. Ideally, the hole should closely surround it user's finger without constricting it. The hole may have slits formed around its circumference, allowing it to enlarge to accept fingers of various sizes. In alternative embodiments, the hole may be square, drop, or oval shaped In one embodiment, the edge of the sheet adjacent to the hole is narrower and substantially rounded, while the edge of the sheet distal from the hole is wider and has a substantially flat edge. In this manner, the sheet resists catching on itself when rolled around a sports equipment handle. In alternative embodiments, the sheet may be oblong, oval, or square shaped, and may have rounded edges.

In order to employ the apparatus, a user inserts a finger, preferably an index finger into the hole, and slides the sheet past both knuckles, such that the hole surrounds the base of the finger. With the sheet anchored on the user's finger, the major portion of the sheet is brought around to rest against the palm side of the user's finger, oriented toward the user's finger tips. Due to the various sizes contemplated, the sheet may extend across two or more fingers depending on the width of the sheet.

With the sheet anchored in position and disposed across a user's fingers, the handle of a piece of sporting equipment is brought into contact with the edge of the sheet distal to the hole. The handle is then rolled toward a user's palm, while causing the sheet to wrap around the handle. Preferably, the handle is brought into proximity with the hole such that no slack remains in the sheet. With the handle rolled into position adjacent a user's thumb and palm, the user may then grip the handle, which is anchored in position by the sheet.

A user may also place the handle at the base of the fingers (where the finger meets the palm) and then wrap the sheet around the handle. Ideally wrapping is performed such that the end of the sheet is pinched between the palm and the handle. The pinching of the sheet when the sheet is wedged between the palm and the handle creates an anchoring grip on a sports equipment handle.

After use, the handle may be released from the sheet by the user simply releasing the handle. When the user's grip is relaxed, the handle is able to rotate toward the user's finger, and the sheet unravels until it disengages the handle. The user may choose to retain the sheet on the finger or remove it for later use as necessary.

DESCRIPTION

Figure 1:
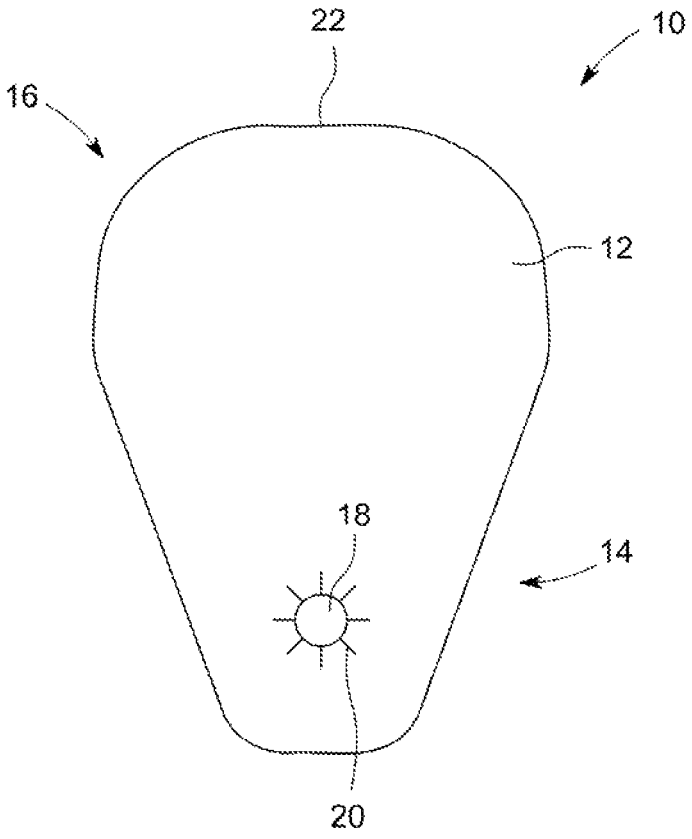
FIG. 1 shows a plan view of the handle gripping apparatus.
Figure 2:
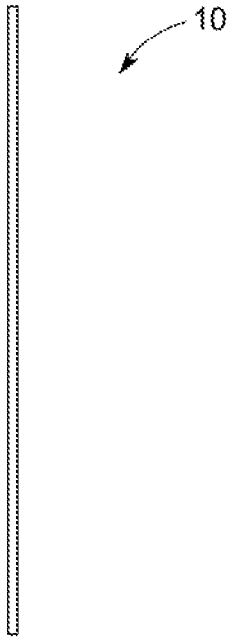
FIG. 2 shows a side view of the handle gripping apparatus.

Referring to FIGS. 1 and 2, an apparatus for improving a user's grip on a sports handle is shown and described. The apparatus 10 comprises a substantially planar sheet 12 having a first end 14 and a second end 16. A hole 18 is disposed in the sheet 12 proximal the first end 14. The sheet is deformable and elastically resilient, allowing it to be rolled around a sports equipment handle (not shown). The sheet may comprise a variety of materials, including rubber, leather, or a resilient cloth-based material. Any material used is preferably slip-resistant.

In one preferred embodiment, the sheet is between approximately one and 1.5 millimeters in thickness. Although the length and width of the sheet may vary according to the sport played, and the nature of the handle gripped, it is anticipated that the sheet in a preferred embodiment may he approximately 3 inches wide and 4 inches long, although larger sizes may be necessary for heavier equipment.

Figure 3:
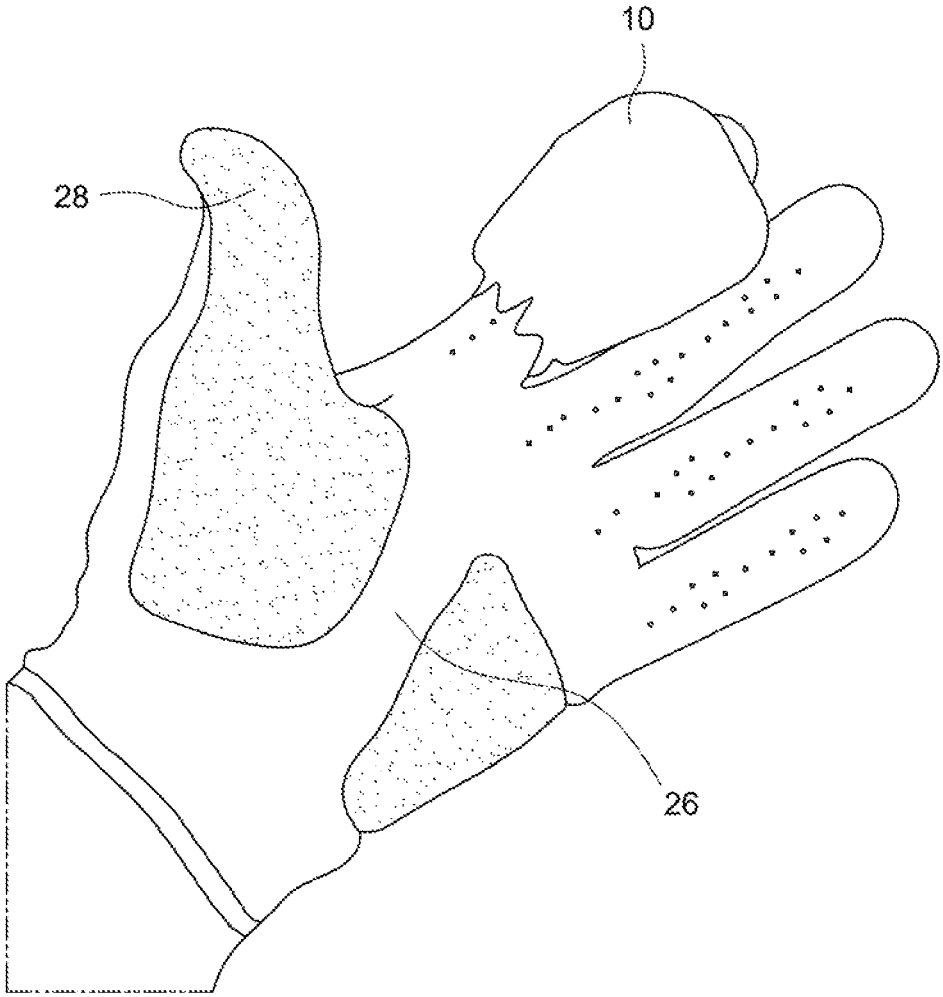
FIG. 3 shows the handle gripping apparatus installed on a user's finger.
Figure 4:
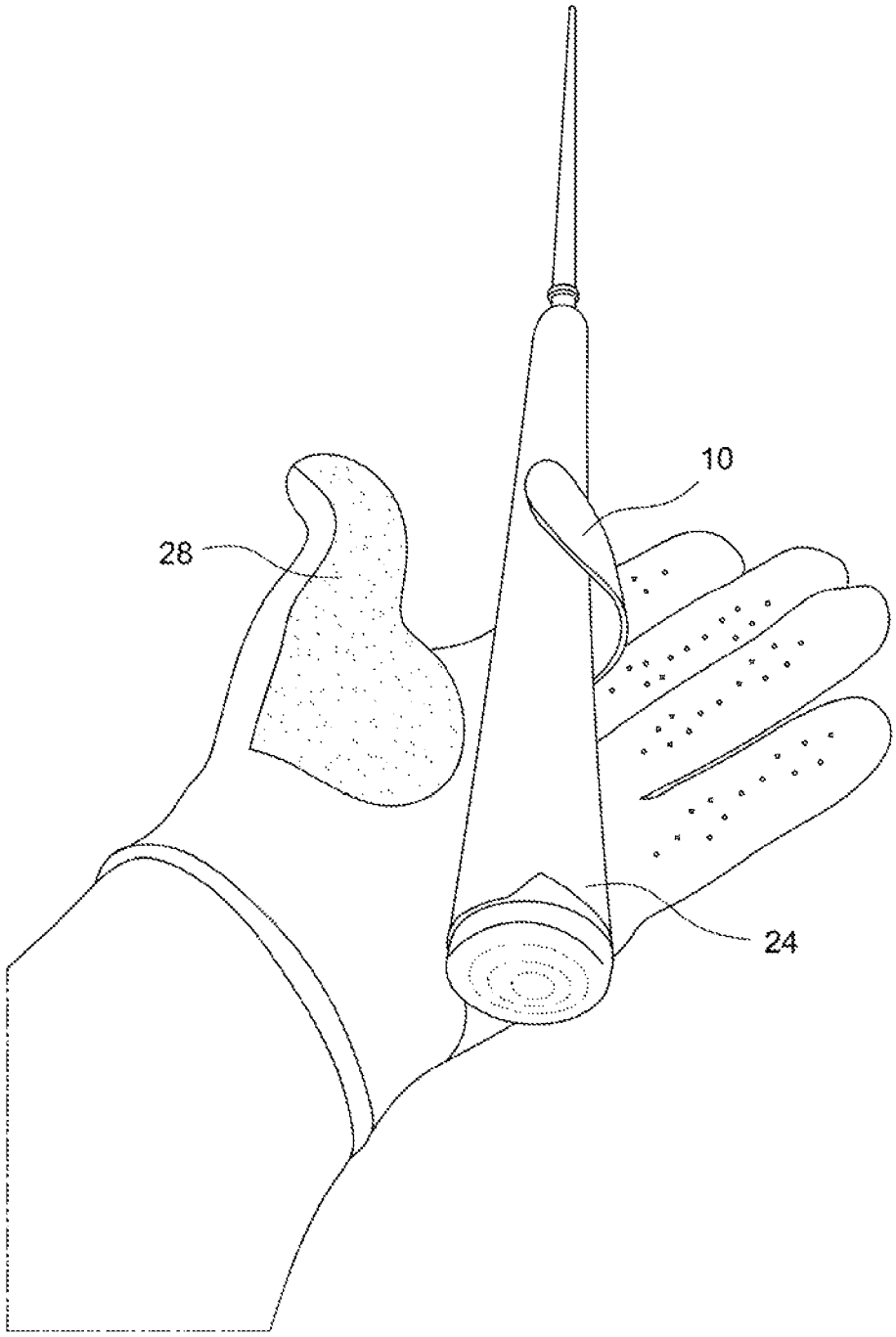
FIG. 4 shows the gripping apparatus being wrapped around a sports equipment handle.
Figure 5:
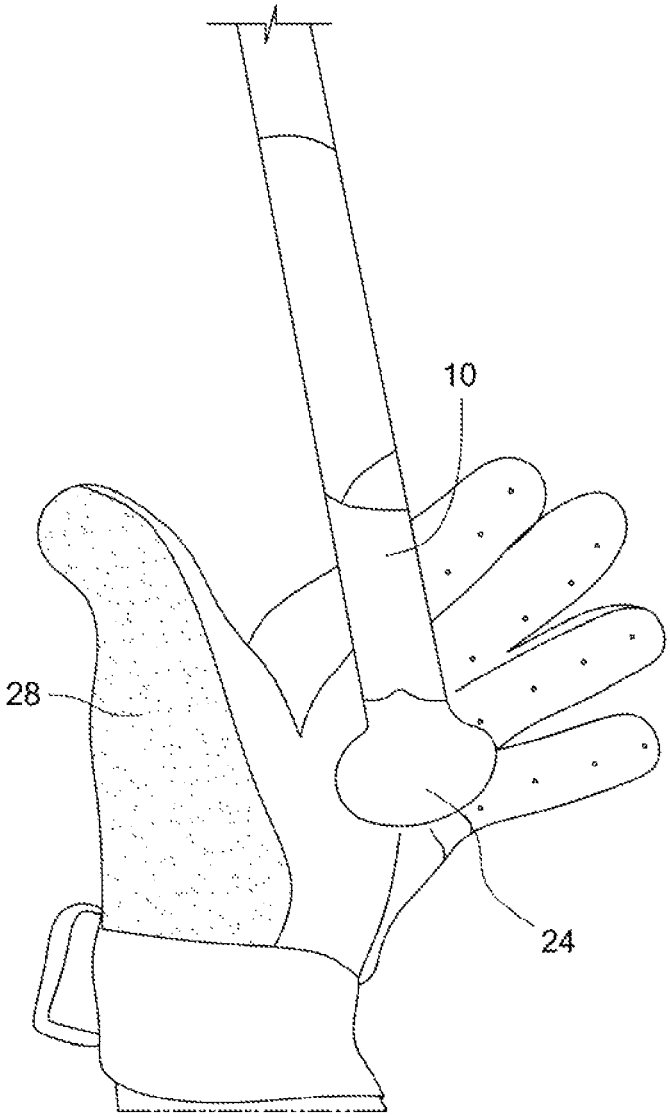
FIG. 5 shows the gripping apparatus fully wrapped around a sports equipment handle.
Figure 6:
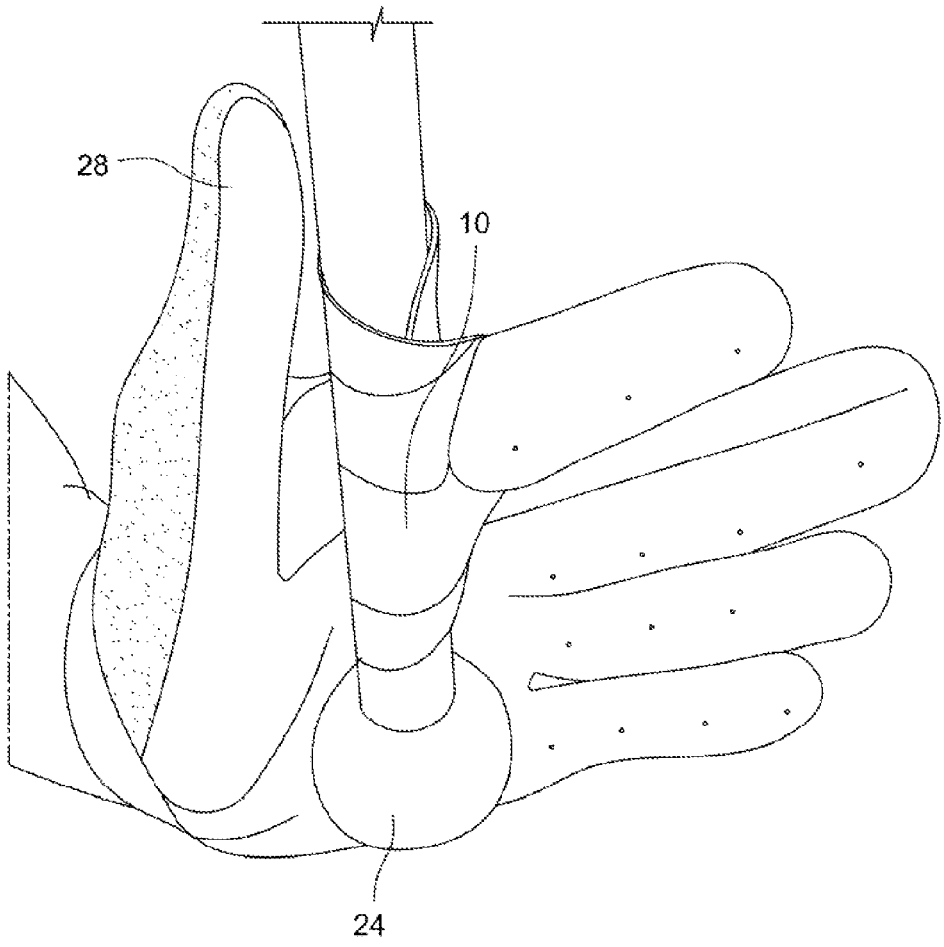
FIG. 6 shows the gripping apparatus and handle adjacent a user's thumb and palm.
Figure 7:
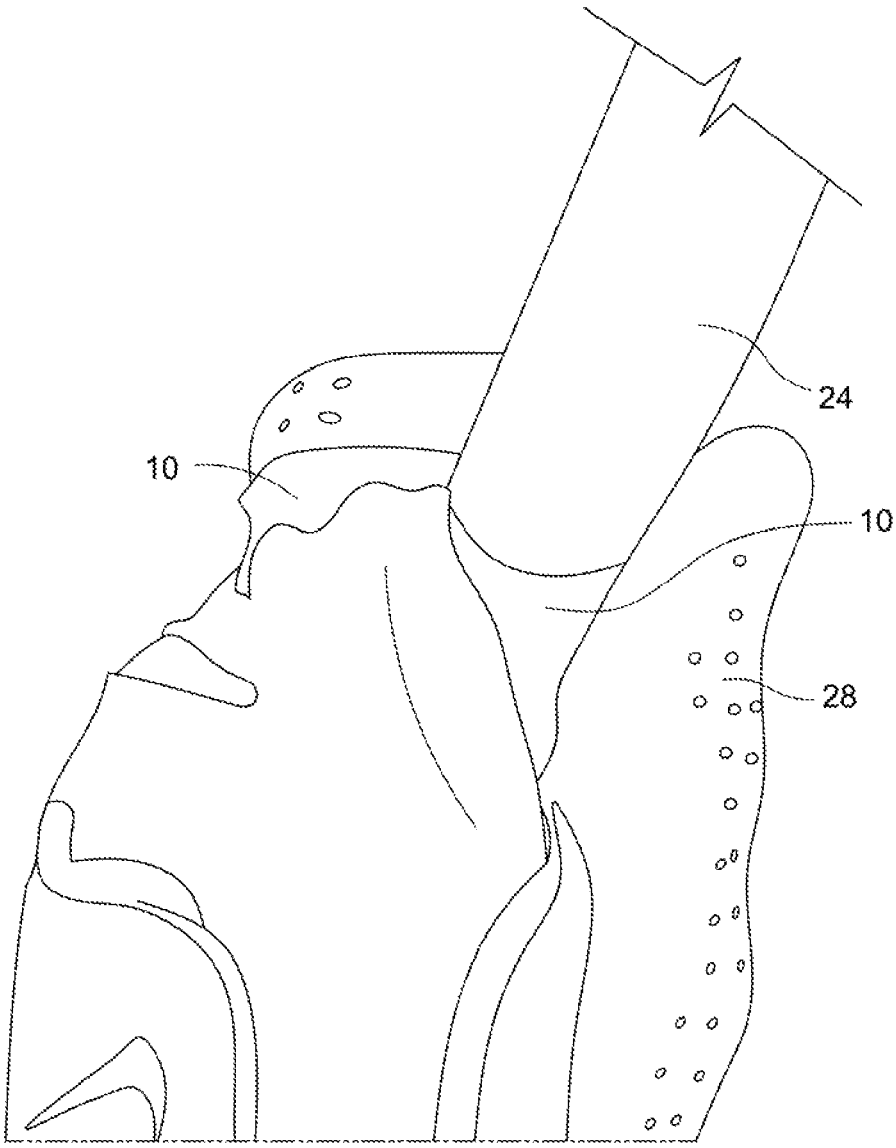
FIG. 7 shows a user gripping a sports equipment handle using the gripping apparatus.

The hole 18 located near the first end 14 of the sheet 12 may be between 1.5 and 2 centimeters in diameter, although a variety of sizes are contemplated depending on the size of a user's finger. The hole 18 is designed to closely surround a user's finger without constricting it. In order to ensure a proper fit, the hole 18 may have slits 20 formed around its circumference which expand as shown in FIG. 3. In alternative embodiments, the hole 18 may be square, drop, or oval shaped.

Still referring to FIGS. 1 and 2, the first end 14 of the sheet 12, which is adjacent to the hole 18 is narrower and substantially rounded, with the edge of the first end 14 conforming to the shape of the hole 18. The second end 16 of the sheet 12 is wider, having a substantially fiat edge 22. With the second end 16 wider than the first end 14, the sheet is unlikely to tangle as narrower portions of the sheet 12 rest above wider portions when the sheet is rolled. In other preferred embodiments, the sheet may be oblong, oval, or square shaped, with rounded edges.

The apparatus 10 having been shown and described, its use will now he discussed.

Referring to FIGS. 3-7, in order to use the sheet 12, a user inserts a finger, preferably an index finger into the hole 18, sling the sheet 12 down such that the hole 18 surrounds the base of the finger. With the sheet 12 anchored on the user's finger, the major portion of the sheet 12 is brought around to rest against the inner side of the finger oriented toward the finger tips. In various alternative embodiments, the sheet 12 may extend across two or more fingers depending on the width of the sheet 12.

With the sheet 12 anchored in position and disposed across a user's fingers, the handle 24 of a piece of sporting equipment is brought into contact with the edge 22 of the sheet 12 distal to the hole 18. The handle 24 is then rolled toward a user's palm 26, while causing the sheet 12 to wrap around the handle 24. Preferably, the handle 24 is brought into proximity with the hole 18 such that no slack remains in the sheet 12. With the handle 24 rolled into position adjacent a user's thumb 28 and palm 30, the user may then grip the handle 24, which is anchored in position by the sheet 12.

After use, the user releases the handle 24 from the sheet 12 by releasing the user's grip. When the user's fingers open, the handle 24 is able to rotate away from the user's palm 26 finger, unraveling the sheet 12 until the sheet 12 disengages the handle 24. The user may choose to retain the sheet 12 on the user's finger or remove it for later use as necessary.

What is claimed is:

1. A method of improving a user's grip on a sports handle comprising the steps of:

inserting a user's finger through a hole disposed near a first end of an elongated deformably resilient sheet;

orienting the sheet so that a major portion of the sheet extends along the palm side of the user's finger toward the fingertip;

placing a side of the sheet against a sporting equipment handle;

rolling the sheet around the handle, thereby bringing the handle proximal a user's thumb and palm; and gripping the sports equipment handle.

2. The method of claim 1, including the step of releasing the user's grip, thereby causing the sheet to unravel and release the handle.

3. The method of claim 1, including the step of removing the sheet from the user's finger.

* * * * *